US006868706B1

(12) United States Patent
Lin

(10) Patent No.: US 6,868,706 B1
(45) Date of Patent: Mar. 22, 2005

(54) 3-ACTION LOCK BARREL

(76) Inventor: Bor-Ching Lin, No. 24, Shuang Ho St., Yung-Ho City, Taipei Hsien (TW)

( * ) Notice: Subject to any disclaimer, the term of this patent is extended or adjusted under 35 U.S.C. 154(b) by 0 days.

(21) Appl. No.: 10/667,661

(22) Filed: Sep. 23, 2003

(51) Int. Cl.[7] ..... E05B 27/00; E05B 29/00
(52) U.S. Cl. ..... 70/492; 70/352; 70/377; 70/392
(58) Field of Search ..... 70/492, 350, 352, 70/491, 490, 377, 392, 367

(56) References Cited

U.S. PATENT DOCUMENTS 1,218,065 A * 3/1917 Diesel ..... 70/492
1,657,039 A * 1/1928 Schafer ..... 70/492
1,850,323 A * 3/1932 Heyer ..... 70/492
2,079,628 A * 5/1937 Olson ..... 70/492
2,629,247 A * 2/1953 Deutsch ..... 70/340
4,750,342 A * 6/1988 Nakai ..... 70/496
5,134,871 A * 8/1992 Makino et al. ..... 70/492
5,205,143 A * 4/1993 Hakkarainen et al. ..... 70/366
5,388,438 A * 2/1995 Haavikko Paavo ..... 70/366
6,003,351 A * 12/1999 Chao et al. ..... 70/366
6,519,989 B1 * 2/2003 Hirvi ..... 70/492

* cited by examiner

*Primary Examiner*—John B. Walsh
(74) *Attorney, Agent, or Firm*—Bacon & Thomas PLLC

(57) ABSTRACT

A three-action lock barrel having collective locking pins and two-way locking up mechanism is comprised of a case, a limiter, multiple locking plates and a rotor; the case being related to a hollow cylinder; a trough axially extending each from the inner wall of the case; the limiter being provided to limit the longitudinal sliding movement of those multiple locking plates arranged in flush and abutted to one another and accommodated inside the limiter; each locking plate being provided with an upper or a lower locking pin selected at random; the rotor receiving insertion of a key; the key turns around to push those locking pins to clear away or insert into a groove.

6 Claims, 8 Drawing Sheets

3-ACTION LOCK BARREL

BACKGROUND OF THE INVENTION (a) Field of the Invention

The present invention is related to a 3-action lock barrel, and more particularly, to one that is adaptable to various types of burglarproof lockset.

(b) Description of the Prior Art

The prior art of the lock barrel for a burglarproof lockset is generally comprised of a rotor, a case, a row or multiple rows of locking pins and spring. Wherein, the rotor is inserted into the case, one row or multiple rows of radial through holes is provided respectively to the rotor and the case for the upper and the lower locking pins to be respectively inserted into each through hole; and a compression spring is provided at the top of the upper locking pin, All the upper and the lower locking pins are restricted at where between the rotor and the case to prevent the barrel from being turned around. To unlock, a key is required to insert into a keyhole of the rotor to push those lower and upper locking pins to slide until the contact surface of those upper and lower locking pins merely falls on the joint where the barrel is engaged to the case to make possible the rotor to be turned around to open up the lockset. However, those upper and lower locking pins for being held by respective springs are exposed in the keyhole of the rotor. That is, the location of each exposed locking pin can be seen. Anyone attempting unauthorized entry may use a probe to insert it into the keyhole to press locking pins one by one (by exercising lateral force) or to simply copy another key to easily unlock the lockset. Therefore, the burglarproof lockset has poor protection results as expected.

SUMMARY OF THE INVENTION

The primary purpose of the present invention is to provide a three-action lock barrel to upgrade identification function. The two-action lock barrel used in a prior art of lockset involves insertion of the key into the rotor, separation of the rotor from the case of the locking pins and turning the key to unlock (two-action relation). Those locking pins longitudinally move on Y-axis indicating its function being related to one-dimension operation. The present invention involves insertion of the key into the rotor, turning around the locking pins (two-action relation), separation of the locking pins from the case to turn the key to unlock (three-action relation). Wherein, the locking pins also longitudinally move along Y-axis; the variation of the thickness among the locking pins takes place on the horizontal X-axis indicating a function of two-dimensional operation. That is, the turning axis of the barrel is related to Variance 1; the longitudinal movement of the locking pin along Y-axis (vertical direction) is related to Variance 2; and the width of the locking pin on X-axis (horizontal direction) is related to the variance depending on the changes of the locking pin movement on X-axis and Y-axis. The present invention by upgrading identification factor from the one-dimensional operation space of the locking pin (up and down) to two-dimensional operation space effectively prevents unauthorized unlocking to maintain the function of the lockset.

DETAILED DES ON OF THE PREFERRED EMBODIMENTS

Figure 1:
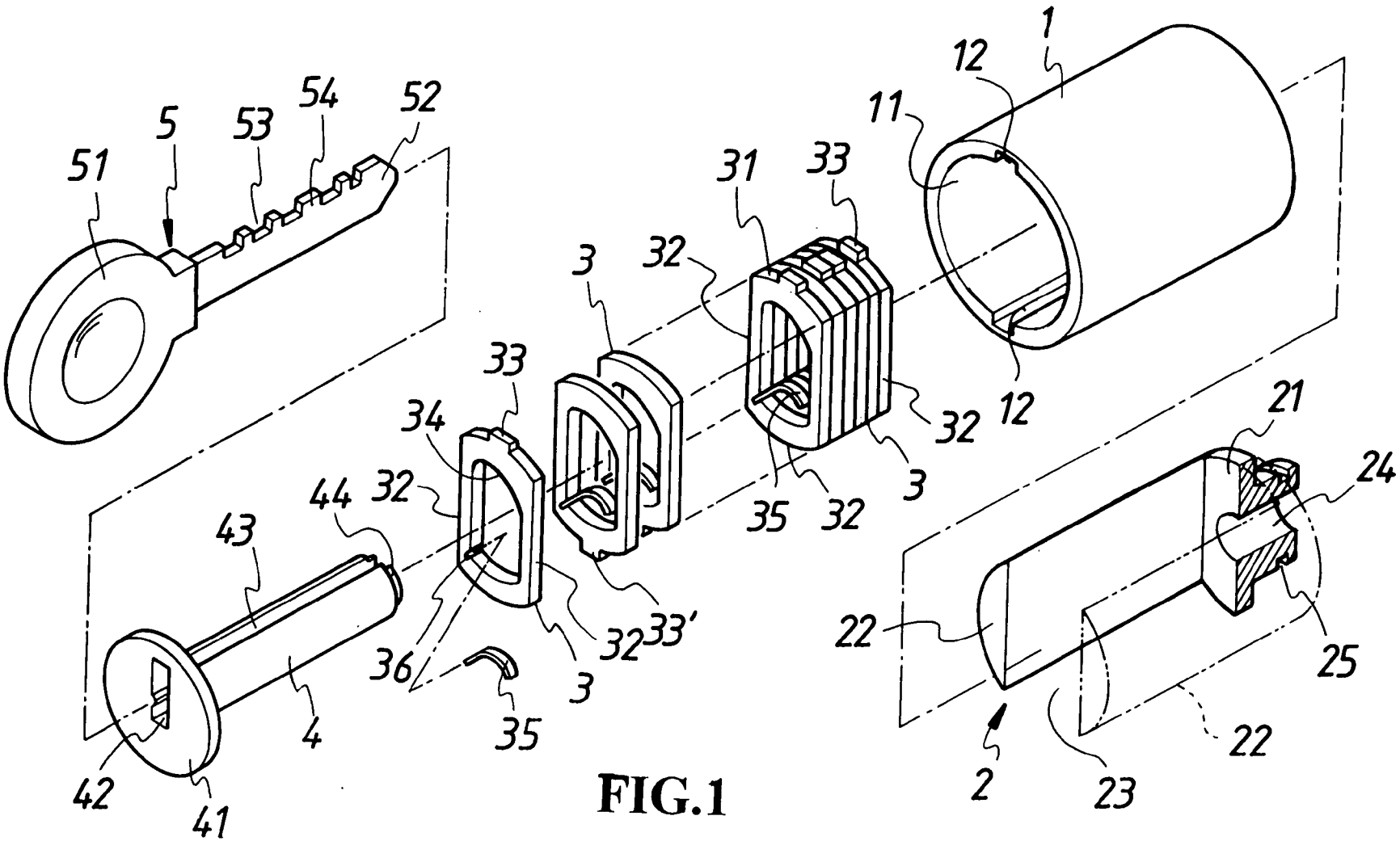
FIG. 1 is an exploded view of a preferred embodiment of the present invention.

As illustrated in FIG. 1, a three-action lock barrel for a lockset includes a case 1, a limiter 2, multiple locking plates 3 and a rotor 4 adapted with a key 5 to unlock. Wherein, the case 1 related to a hollow cylinder mounted to a burglarproof lockset has at its middle provided with a circular hole 11 to accommodate the limiter 2, those multiple locking plates 3 and the rotor 4, and at two selected relative locations on the inner wall of the circular hole 11 respectively provided with a groove 12 extending axially.

Figure 2:
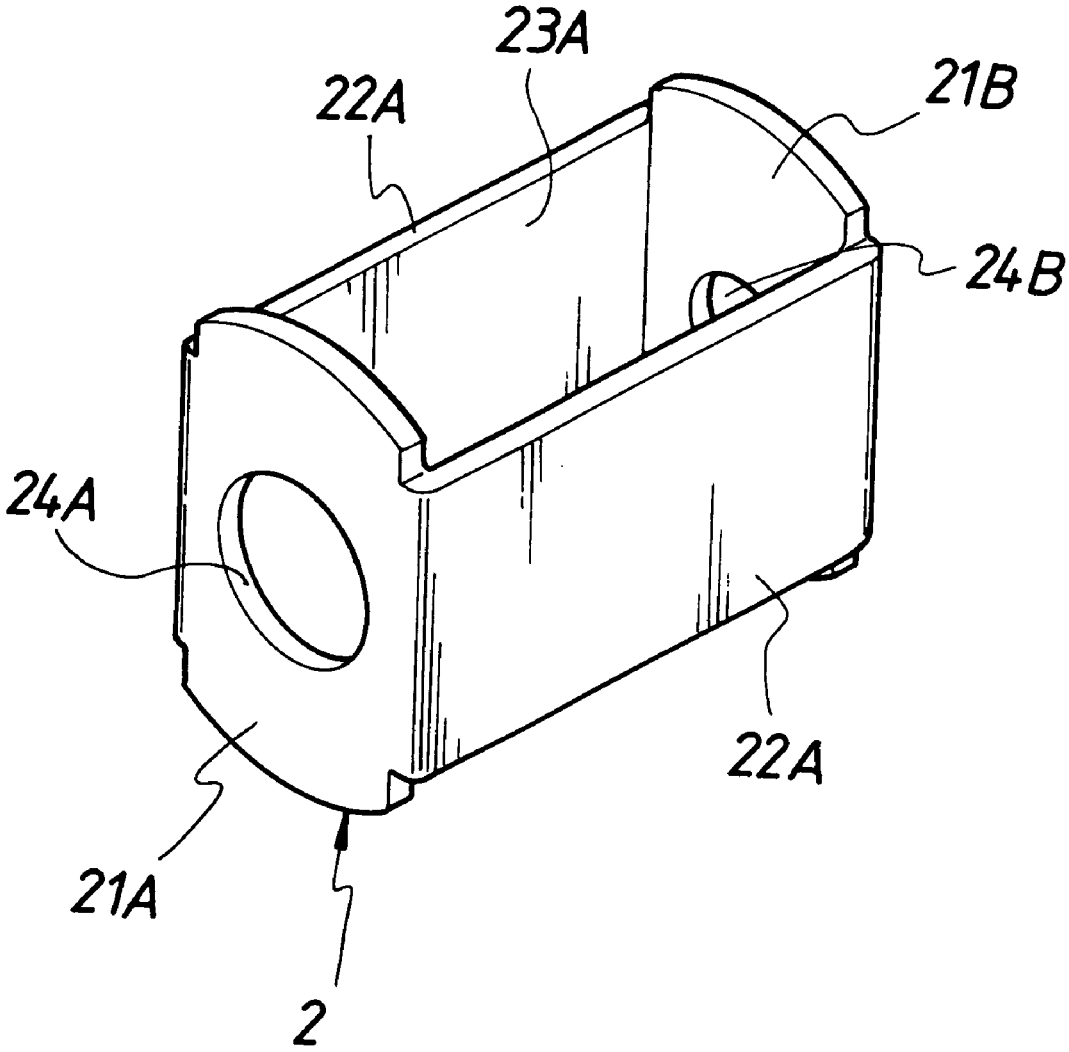
FIG. 2 is a perspective view of a limiter of another preferred embodiment of the present invention.

The limiter 2 mounted inside the case 1 has on its both sides respectively provided with a limiting plate 22 (22A), to define a room 23 (23A) formed with a longitudinal open space to accommodate and limit (guide) those multiple locking plates 3 arranged in flush to engage longitudinal sliding movement as illustrated in FIG. 1. The limiter 2 can be driven to rotate to unlock and substantially formed in a structure having both sides at the front end of a circular plate 21 respectively provided with a semi-circular limiting plate 22 to define the room 23, a circular hole 24 provided at the center of the circular plate 21, and a connection part 25 at the rear end of the circular plate 21 to engage other members (e.g., a dialer) of the lockset. The limiter 2 can be also a punched and folded metal plate in another preferred embodiment as illustrated in FIG. 2. Wherein, two oval plates 21A, 21B are respectively formed at the front and the rear ends of the limiter 2 with each folded on opposite site a limiting plate 22A to enclosure to define a longitudinally open room 23A. A circular hole 24A (24B) is each provided at the center of the oval plate 21A (21B) with the rear end of the oval plate 21B engaged with other members of the lockset.

Those multiple locking plates 3 are arranged abutted to one another. Each locking plate 3 indicates the shape of having two arc edges 31 at both of its upper and lower sides and two symmetric right and left sides 32 in parallel. Each of all the locking plates 3 is provided with an upper locking pin 33 or a lower locking pin 33' either at its upper arc edge or the lower arc edge 31 at random. An inclined arc plane 34 is provided on the upper edge and an elastic member 35 at the lower edge in each locking plate 3. The elastic member 35 is made in an arc form. A sink 36 is provided at the lower edge inside each locking plate 3 to receive insertion of the elastic member 35 to hold it in position.

The rotor 4 receiving insertion and turning of the key 5 for the key 5 to dial those multiple locking plates 3 is made in a cylindrical column having at its front end provided with a circular plate 41 in a diameter greater than that of the rotor 4, and a keyhole 42 is provided at the front end of the circular plate 41 axially extending into the rotor 4. A groove 43 is formed on the body of the rotor 4 and the rear end of the rotor 4 is provided with a round pillar 44 to be inserted into the circular hole 24 (24B) provided one end of the limiter 2 to turn around the limiter 2.

The key 5 related to a work piece to correctly unlock the lockset has at its rear end provided with a turning plate 51 and at its front end a key blade 52. Multiple concave keyways 53 and convex keyways 54 corresponding to those multiple locking plates 3 are provided at a selected edge of the key blade 52.

Figure 3:
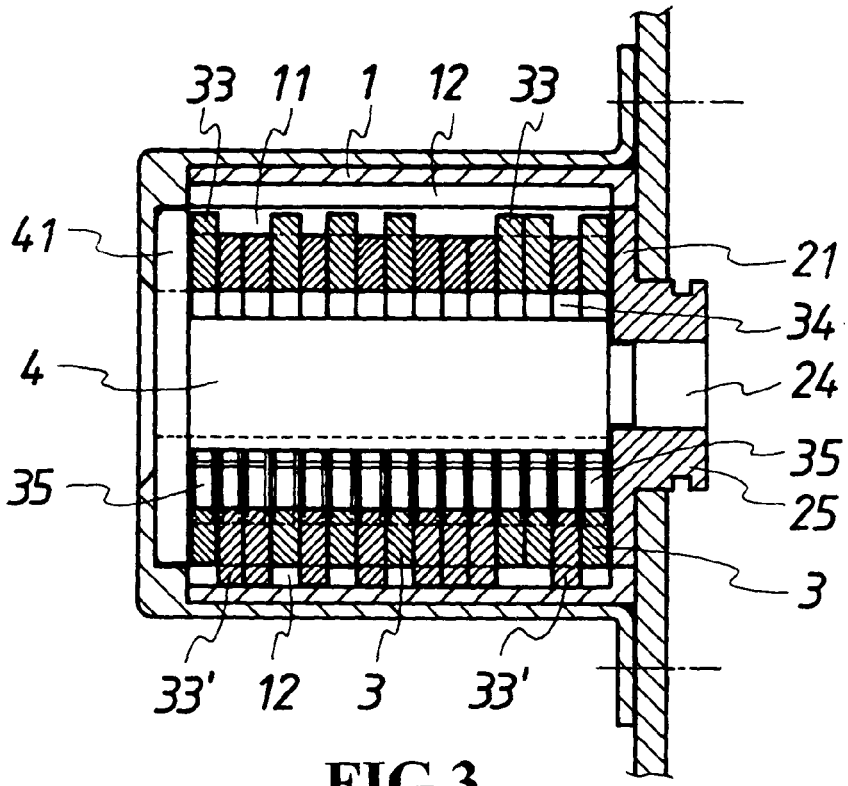
FIG. 3 is a sectional view showing that the lower locking pins of the locking plate falls in to lock up.

As illustrated in FIGS. 1 and 3, the limiter 2 with its circular plate 21 or oval plate 21B as the rear end is inserted into the case 1, and those multiple locking plates 3 are accommodated in the room 23 (23A) inside the limiter 2. The limiting plate 22 (22A) of the limiter 2 covers up both sides of those multiple locking plates 3. The rotor 4 penetrates through and is placed in those multiple locking plates 3 for the elastic member 35 to hold against the lower side of the rotor 4. The round pillar 44 at the rear end of the rotor 4 and the circular hole 24 (24B) of the limiter 2 are now can be turned around to complete the assembly of a 3-action lock barrel of the present invention.

Figure 5:
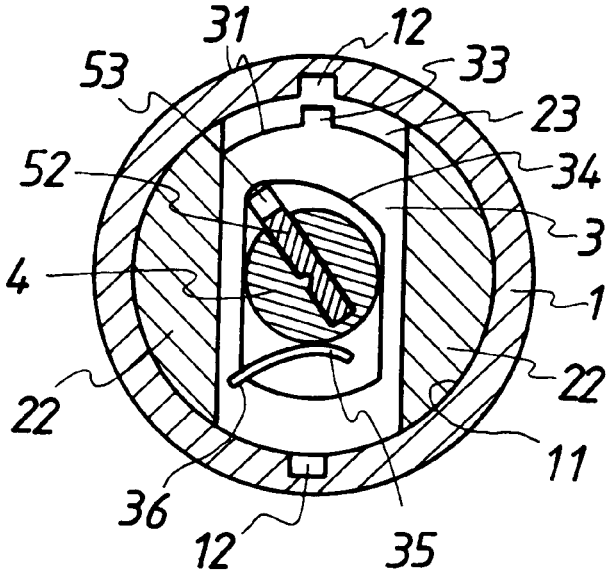
FIG. 5 is a schematic view showing that the upper locking pin of the locking plate falls out of a groove in normal condition.
Figure 6:
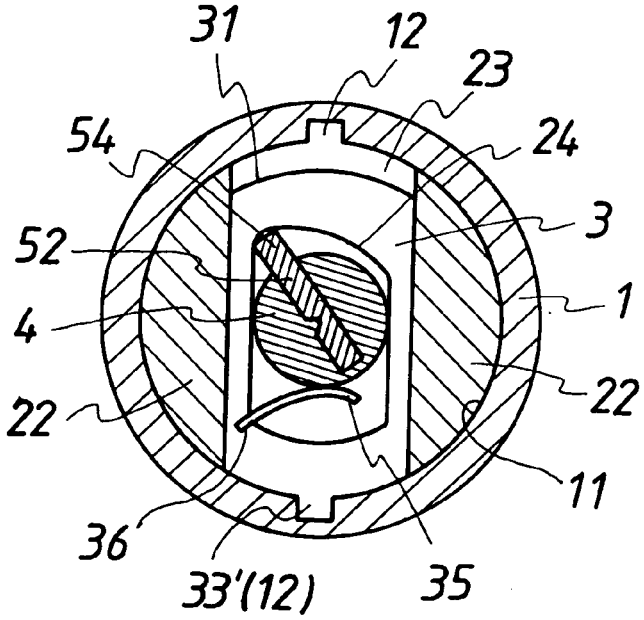
FIG. 6 is a schematic view showing that the lower locking pin of the locking plate is inserted into the groove in normal condition.

In use, those multiple locking plates 3 normally sink for being held against by the elastic member 35; therefore, for several locking plates 3, their upper locking pins 33 normally stay away from the groove 12 over the case 1 as illustrated in FIGS. 3 and 5 while their lower locking pins 33' are normally inserted into the groove 12 below the case 1 as illustrated in FIGS. 3 and 6 to prevent those multiple locking plates 3 and the limiter 2 from being turned by taking advantage of having those lower locking pins 33' inserted into the groove 12.

Figure 4:
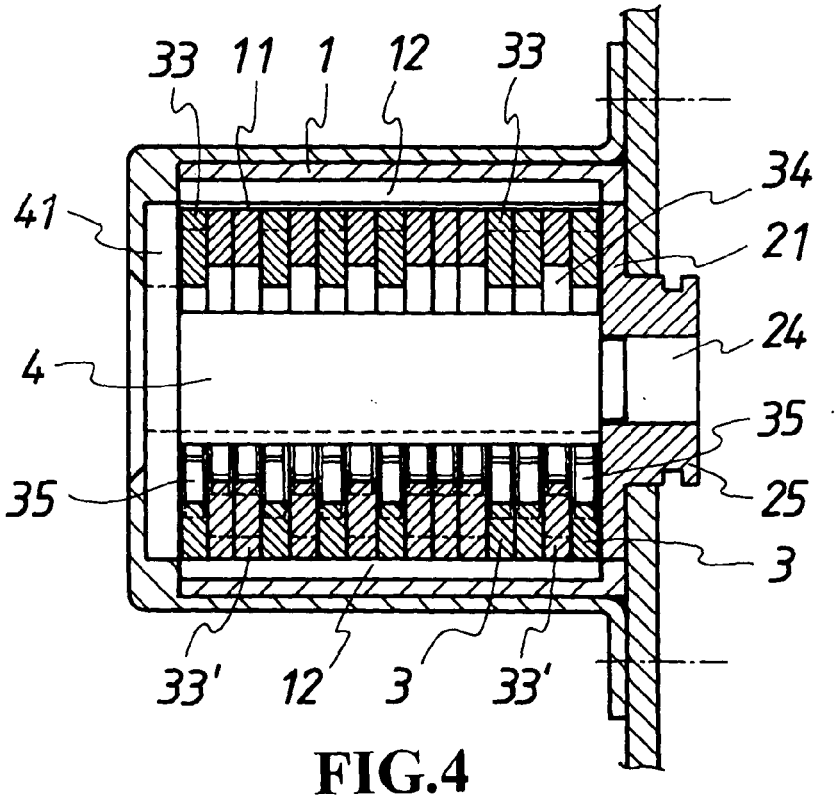
FIG. 4 is a sectional view showing that the lower locking pins of the locking plate falls off to unlock.
Figure 7:
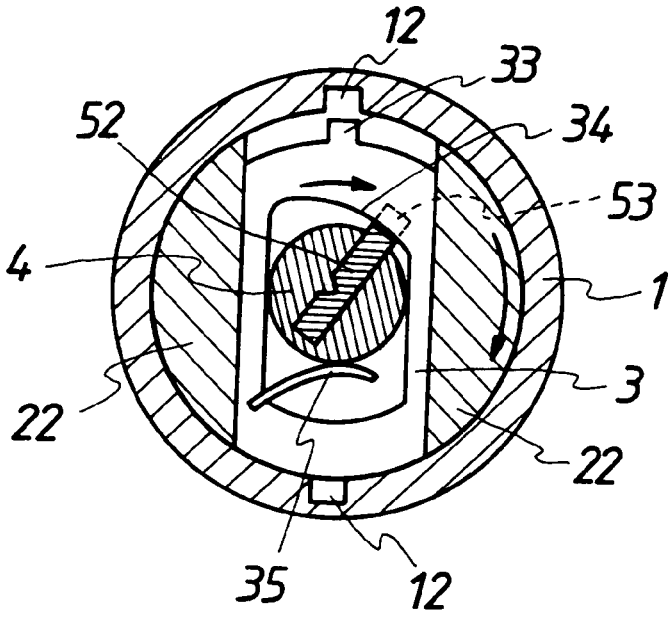
FIG. 7 is a schematic view showing that a concave keyway escapes from an inclined arc plane of the locking pin.
Figure 8:
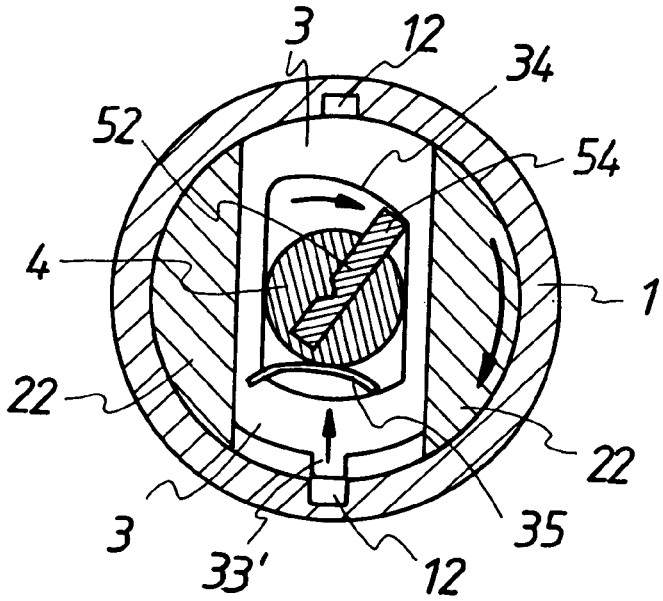
FIG. 8 is a schematic view showing that a convex keyway of the key pushes against the inclined arc plane of the locking pin.

However, once the key 5 is inserted through keyhole 42 of the rotor 4 while allowing a concave keyway 53 and a convex keyway 54 to be exposed from the groove 43 of the rotor 4, a concave keyway 53 and a convex keyway 54 respectively in relation to their locking plates 3 are located on the inner side of the inclined arc plane 34, and the key 5 is turned to allow the convex keyway 54 to rotate and hold against the inclined arc plane 34, resulting in an upward component for those locking plates 3 provided with lower locking pins 33' to slide upward to clear away from the groove 12 below the case 1 as illustrated in FIGS. 4 and 8. Those locking plates 3 provided with upper locking pins 33 maintain having their upper locking pins 33 to stay in normal position of clearing away from the upper groove 12 over the case 1 while the concave keyway 53 rotates to duck away the movement of the inclined arc plane 34 as illustrated in FIGS. 4 and 7. Accordingly, those multiple locking plates 3 and the limiter 2 are turned to unlock.

Figure 9:
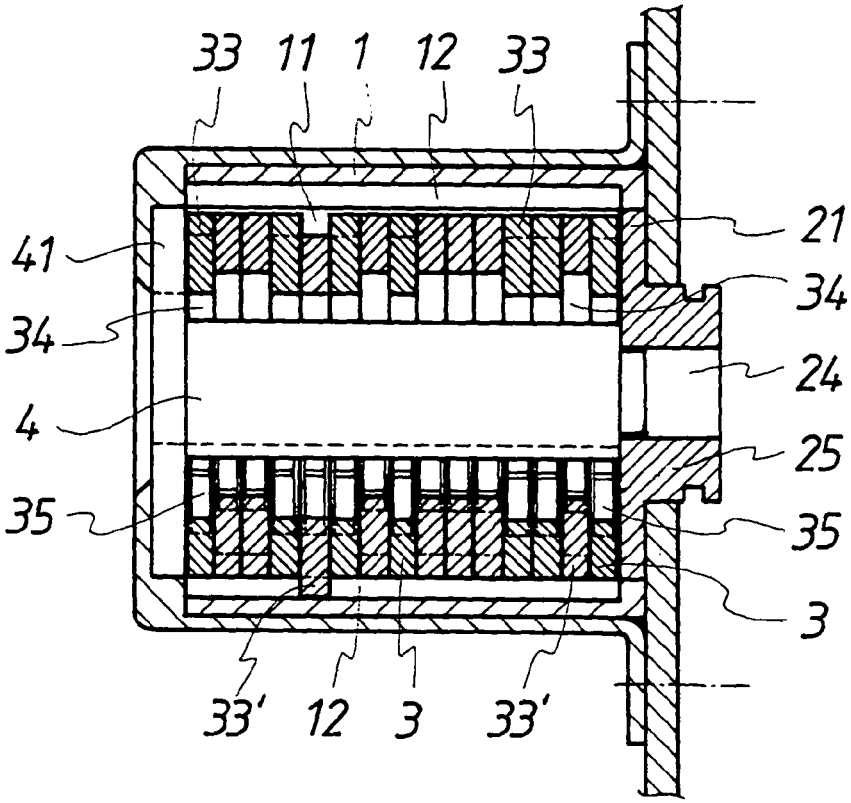
FIG. 9 is a sectional view showing that the lower locking pin is locked up due to a false key fails to push against the locking plate.
Figure 10:
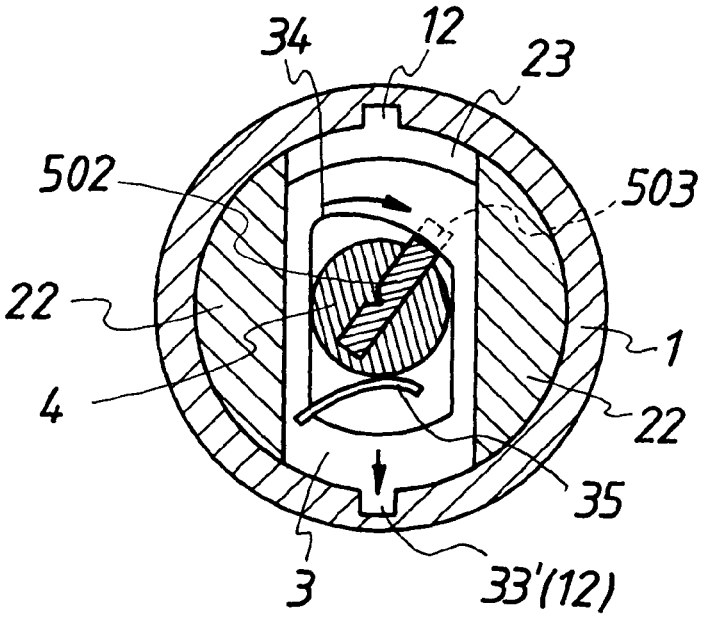
FIG. 10 is a schematic view showing that the lower locking pin is locked up due to a false key fails to push against the locking plate.
Figure 11:
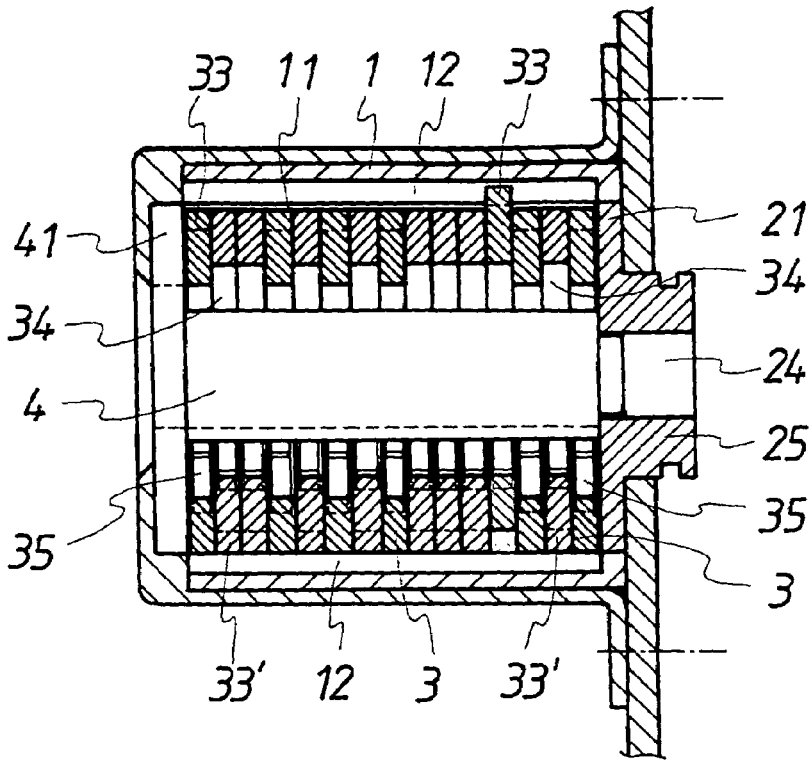
FIG. 11 is a sectional view showing that the upper locking pin is locked up due to a false key pushes against the locking plate.
Figure 12:
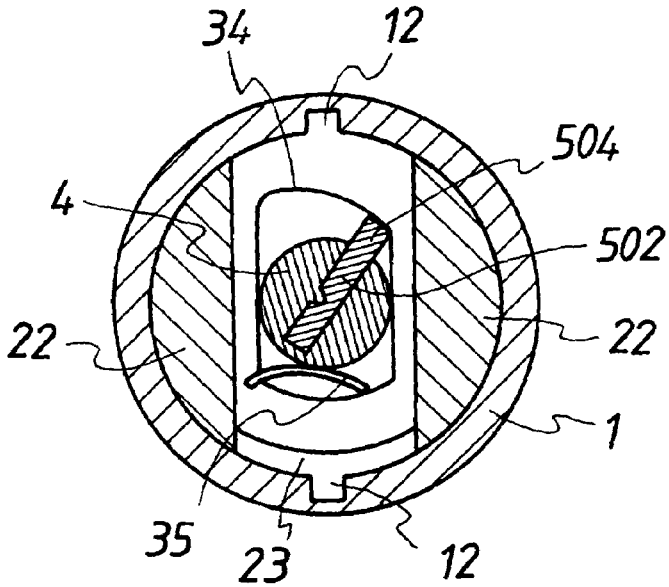
FIG. 12 is a schematic view showing that the upper locking pin is locked up due to a false key pushes against the locking plate.

If another key 50 is inserted to attempt unlocking as illustrated in FIGS. 9, 10, 11 and 12. The width, height, and working direction of the concave keyway 503 and convex keyway 504 of another key 50 must exactly match the thickness, sliding height and the direction of the locking pin to clear away the groove of each locking plate. Any concave keyway 503 is at a position corresponding to a locking plate 3 provided with the lower locking pin 33', turning the key 50 fails to push up the inclined arc plane 34 of the locking plate 3 for the lower locking pin 33' to clear away upwards as illustrated in FIGS. 9 and 10 to unlock. On the other hand, if any convex keyway 504 is aligned to a locking plate 3 provided with an upper locking pin 33, turning the key 50 pushes to move the inclined arc plane 34 of the locking plate 3 for the upper locking pin 33 to be inserted into and locked in the groove 12 over the case 1 as illustrated in FIGS. 11 and 12. Again, the unlocking fails whenever some one attempts to unlock the lockset by a mock key 50. As long as any of the width or height of the concave keyway 503 or the convex keyway 504 fails to match the thickness and sliding height of its corresponding locking plate 3, the unlocking will eventually fails. Furthermore, if a probe or other similar tool is used to enter into the keyhole 42 to attempt unlocking by directly pushing those locking plates 3, those locking plates 3 naturally produce collective shielding effect (i.e., the absence of individual performance) since those upper and lower locking pins 33, 33' are provided in concealment. The probe will fails as frustrated by the individual locking plate. Vertical and horizontal components created from the fact that the locking plates slide up and down depending on the arc curve relation further frustrates the unlocking attempt since there is no way to find out which locking plate 3 should be pushed up or which locking plate 3 should not be pushed up. Therefore, the possibility of unlocking the lockset by sticking a probe into the keyhole 42 is ruled out. The present invention by providing concealment, shielding effect and arc curve features achieves for the lockset significantly improved burglarproof results.

Figure 13:
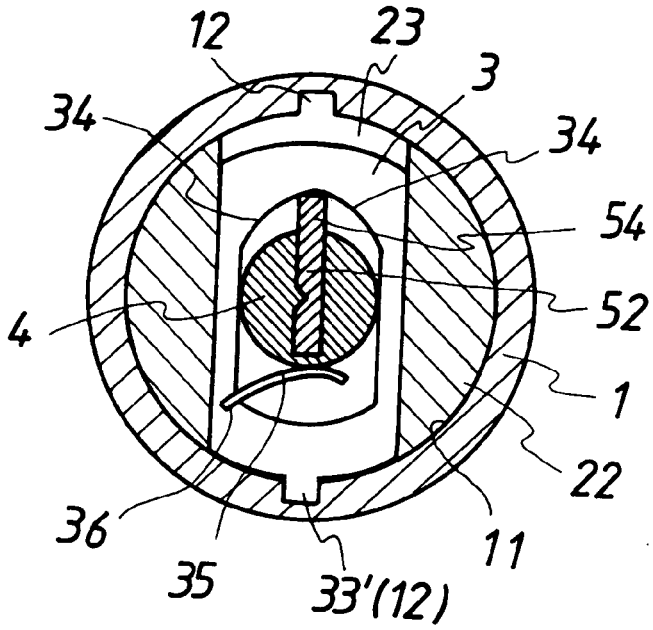
FIG. 13 is a schematic view showing that the locking pin is provided with two inclined arc planes.
Figure 14:
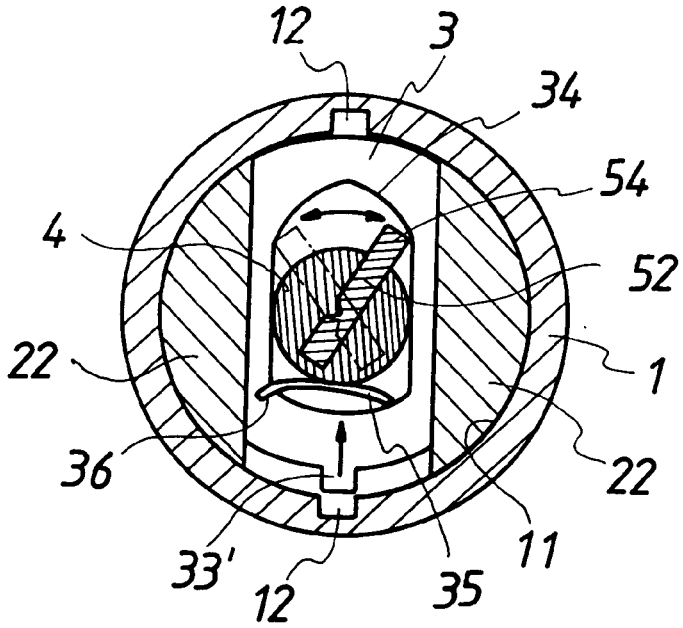
FIG. 14 is a schematic view showing the operation of the locking pin provided with two inclined arc planes.

As described above, the inclined arc plane 34 is provided on the upper edge inside each of those multiple locking plates 3. Alternatively, as illustrated in FIGS. 13 and 14, two inclined arc planes 34 are provided in symmetric. In case of only one inclined arc plane 34 is provided, the key 5 is used to push those locking plates 3 in one direction and to twist the limiter 2 also in one direction so to open up a lockset that requires only to be unlocked by turning in one direction. If it takes consecutive turning into two directions for opening up and locking up the lockset, such as a multi-section door lock, two symmetric inclined arc planes 34 can be adapted to those multiple locking plates 3 to achieve the purposes of turning the barrel clockwise to lock up and counterclockwise to open up the lockset.

What is claimed is:

1. A three-action lock barrel is essentially comprised of a case, a limiter, multiple locking plates and a rotor; wherein, the case related to a hollow cylinder having at its center provided with a circular hole and an axially extending trough each respectively provided on the inner wall of the circular hole;

the limiter inside the case having a limiting plate each provided on both sides to define a longitudinally open room to accommodate and limit those multiple locking plates; those multiple locking plates being arranged in flush to engage longitudinal sliding movement; and the limiter being driven by those multiple locking plates to rotate to unlock a lockset; those multiple locking plates arranged being abutted to one another; each locking plate having two arc edges at both of its upper and lower sides and two symmetric right and left sides in parallel, and provided with an upper locking pin or a lower locking pin either at its upper arc edge or the lower arc edge at random; an inclined arc plane being provided on the upper edge and an elastic member at the lower edge in each locking plate; and the rotor related to a cylinder provided to receive insertion of a key to unlock the lockset having provided at the front end of the rotor a keyhole axially extending through the lock barrel, and a groove being formed on the body of the rotor; characterized by that:

the limiter having the rear end a circular or oval plate penetrating through and placed in the case; those multiple locking plates being accommodated in the room of the limiter; the limiter having its limiting plates to cover up those multiple locking plates on both sides; the rotor being inserted into those multiple locking plates; and the elastic member holding against the lower side of the rotor.

2. A three-action lock barrel as claimed in claim 1, wherein, one inclined, or alternatively two in symmetric, arc plane is provided on each of those multiple locking plates.

3. A three-action lock barrel as claimed in claim 1, wherein, the limiter is formed with a circular plate having on both sides of its front end respectively provided a semi-circular limiting plate to define the space between two limiting plates a longitudinally open room; and a round hole provided at the center.

4. A three-action lock barrel as claimed in claim 1, wherein, the limiter alternatively is related to a punched and folded metal plate; an oval plate being each provided at the front and the rear ends of the limiter, a flat limiting plate being folded each on both sides of those two oval plates to define a longitudinally open room between two limiters; and a round hole being each provided at the center of two oval plates.

5. A three-action lock barrel as claimed in claim 1, wherein, the elastic member relates to an arc elastic plate; a sink being provided at the lower edge of each locking plate; and the elastic member being inserted into and held in position by the sink.

6. A three-action lock barrel as claimed in claim 1, wherein, a circular pillar is provided to the rear end of the rotor; and the rotor being engaged to the limiter for both to be turning around.

* * * * *